United States Patent [19]

Hall et al.

[11] Patent Number: 4,584,914

[45] Date of Patent: Apr. 29, 1986

[54] RETAINER WRENCH

[75] Inventors: Charles T. Hall, Danville; Harry L. Woodard, Sheffield; Jimmy C. Terry, Courtland; Curtiss O. Willis, Muscle Shoals; Phil W. Hendrix, Decatur, all of Ala.

[73] Assignee: Champion International Corporation, Stamford, Conn.

[21] Appl. No.: 636,625

[22] Filed: Aug. 1, 1984

[51] Int. Cl.[4] ..... B25B 13/48

[52] U.S. Cl. ..... 81/176.15; 81/461

[58] Field of Search ..... 81/176.15, 461, 436, 81/438, 460, 451

[56] References Cited

U.S. PATENT DOCUMENTS

| | | | |
|---|---|---|---|
| 1,129,049 | 2/1915 | Smith | 81/461 X |
| 3,449,988 | 6/1969 | Gallo | 81/451 X |
| 3,821,975 | 7/1974 | Haker | 81/461 |

FOREIGN PATENT DOCUMENTS

| | | | |
|---|---|---|---|
| 567885 | 3/1958 | Belgium | 81/461 |

*Primary Examiner*—James G. Smith

*Attorney, Agent, or Firm*—Evelyn M. Sommer; John H. Mulholland; William W. Jones

[57] ABSTRACT

A wrench for removing and installing cylindrical retainers, particular sight glass retainers comprises a base member, a guide member and a pair of projections. The base member has a planar stop surface on one axial end. The guide member is fixed to the base member and extends perpendicularly from the stop surface. The projections extend in opposite directions from the guide member parallel to and over the stop surface. When coupled to a sight glass retainer, the stop surface engages an exposed axial end portion of the retainer, the guide member engages the retainer inner cylindrical surface, and the projections are received within diametrically opposite recesses in the retainer end portion.

10 Claims, 5 Drawing Figures

RETAINER WRENCH

FIELD OF THE INVENTION

The present invention relates to a retainer wrench for removing and installing retainers of the type used for securing oil sight glasses. The present invention also relates to the combination of the wrench and retainer.

BACKGROUND OF THE INVENTION

In fluid systems in various industries, sight glasses are provided to permit visual inspection of the fluid being conveyed through a conduit. The sight glass is positioned within a housing and is secured within the housing by a generally cylindrical, tubular retainer which is threaded within the housing. The retainer only has a relatively small axial end portion which protrudes from the housing. Only this relatively small axial end portion of the retainer may be gripped for installing and removing the retainer. Diametrically opposite recesses are formed within the exposed end portion of the retainer for facilitating its removal.

Conventional methods for removing and tightening sight glasses have employed a screwdriver or a channel locks. However, neither the screwdriver nor the channel locks works satisfactorily. Additionally, such conventional methods often damage the sight glass and/or retainer. In locations having extremely limited access due to obstructions and limited availability of space, it is impossible to use a screwdriver or channel locks to remove or secure the retainer.

SUMMARY OF THE INVENTION

It has now been discovered that the disadvantages associated with using conventional tools for removing and installing sight glass retainers are eliminated by employing a wrench comprising a base member, a guide member and a pair of projections. The base member has a planar stop surface on its first end. The guide member is fixed to and extends perpendicularly from the stop surface. The pair of projections extend in opposite directions from the guide member parallel to and over the stop surface.

When the wrench is coupled to the retainer, the base member stop surface engages the exposed end portion of the retainer, the guide member engages the inner surface of the retainer, and the projections extend through the diametrically opposite recesses within the retainer exposed end portion. Engagement of the base member stop surface and the retainer end portion prevents over-insertion of the tool, thereby preventing damage to the sight glass. The guide member properly positions the tool relative to the retainer. The engagement of the projections in the exposed end portion recesses provides a positive driving engagement of the wrench and retainer such that turning of the wrench causes simultaneous rotation of the retainer.

Thus, the wrench prevents damage to the retainer and sight glass, makes removal and installation safer, easier and quicker, and facilitates access in difficult to reach areas.

The base member can include a coupling for positively engaging a handle to provide a lever arm in rotating the wrench. Preferably, this coupling comprises a polygonal bore in an opposite second end of the base member to facilitate attachment of a standard ratchet drive assembly to the wrench.

Preferably, the guide member comprises a cylindrical tube having recesses in its end fixed to the base member. The projections are preferably formed by a single, elongated bar extending across the stop surface and through the recesses in the hollow guide member. This arrangement facilitates manufacture of the wrench, reduces its weight and improves its strength and handling.

Other advantages and salient features of the present invention will become apparent from the following detailed description, which, taken in conjunction with the annexed drawings, discloses a preferred embodiment of the present invention.

DETAILED DESCRIPTION OF PREFERRED EMBODIMENT

Figure 1:
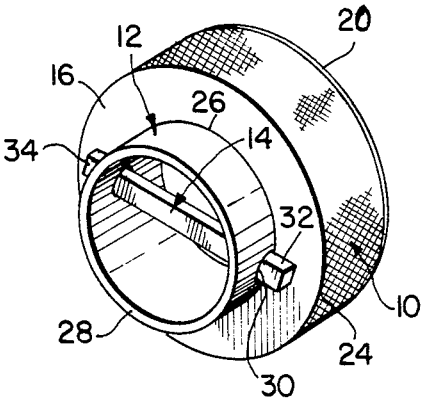
FIG. 1 is a perspective view of a retainer wrench according to the present invention.
Figure 2:
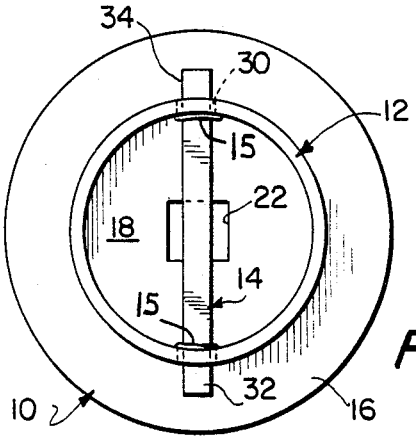
FIG. 2 is a top plan view of the retainer wrench of FIG. 1.
Figure 3:
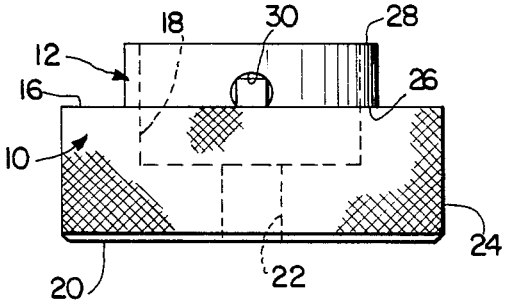
FIG. 3 is a side elevational view of the retainer wrench of FIG. 1.

Referring initially to FIGS. 1-3, the retainer wrench of the present invention comprises a base member 10, a guide member 12 and a bar 14 extending diametrically across and projecting laterally from the guide member. Each of the three parts are fixedly coupled to one another, e.g., by welding at 15. The parts are formed of metal, preferably carbon steel.

Base member 10 is in the form of a right cylinder. A substantially planar stop surface 16 is formed as one axial end of the base member. An opening 18 is formed in the center of stop surface 16 such that the opening is surrounded by the stop surface. Extending inwardly from the opposite axial end face 20 of base member 10 is a bore 22 having a polygonal transverse cross-sectional configuration. Preferably, bore 22 has a square transverse cross-sectional configuration of a size to receive the drive shaft of a three-eighth inch ratchet socket wrench drive assembly. The cylindrical exterior surface 24 of the base member is knurled to facilitate gripping.

Typically, the base member has a transverse diameter of approximately 2.437 inches and a thickness of approximately 0.875 inches. The bottom of opening 18 is spaced approximately 0.5 inch from end face 20. Opening 18 has a transverse diameter of approximately 1.375 inches.

Guide member 12 is in the form of a right cylindrical tube with one axial end 26 secured to stop surface 16 of base member 10 and its opposite axial end 28 extending parallel to stop surface 16. Diametrically opposed recesses 30 extend through the guide member adjacent end 26.

Typically, the tubular member forming guide member 12 has an outer diameter of approximately 1.620 inches and an inner diameter of 1.375 inches. Recesses 30 are formed by using a one-quarter inch drill. The guide member has an axial length of approximately 0.375 inches.

Elongated bar 14 lies on stop surface 16 and extends diametrically across opening 18 and cylindrical guide member 12. The opposite end portions of the bar extend through recesses or openings 30 to form projections 32 and 34. In transverse cross-section, the bar is rectangular, and is preferably square.

Typically, the bar has a length of approximately 2 inches and a width and thickness of 3/16 inch. The bar can be typically formed from key stock.

Figure 4:
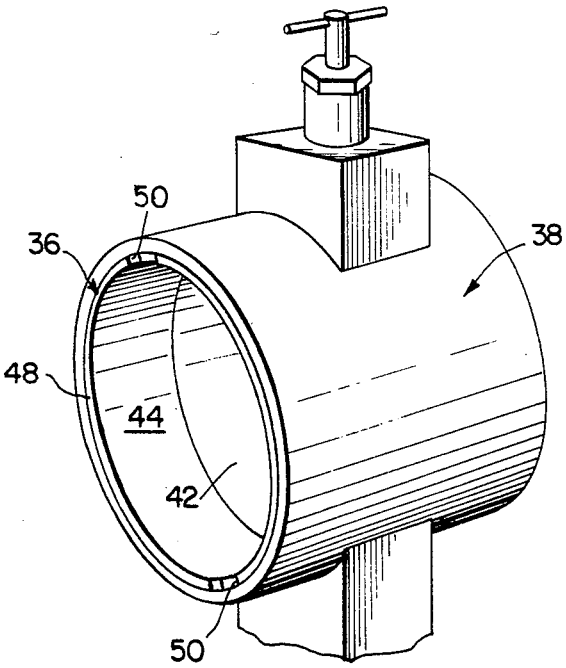
FIG. 4 is a sight glass assembly for use with the retainer wrench of FIG. 1.
Figure 5:
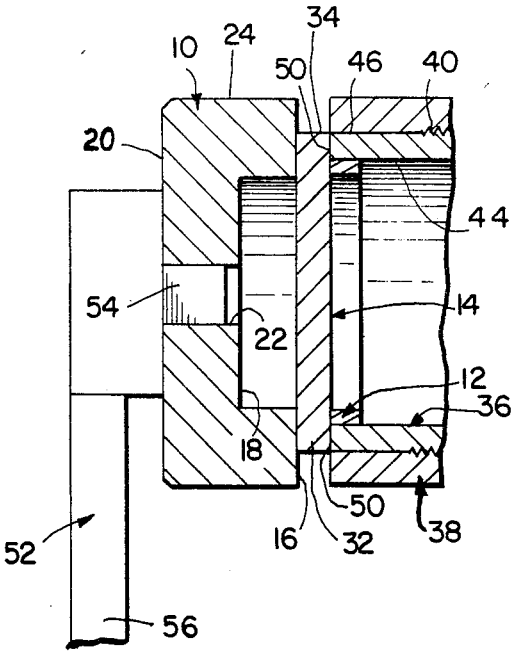
FIG. 5 is a side elevational view in section of the retainer wrench of FIG. 1 coupled to a sight glass retainer.

The wrench of the present invention is particularly useful for removing and installing oil sight glass retainers of the type illustrated in FIGS. 4 and 5. Retainer 36 is secured within housing 38 by threads 40. The retainer secures a sight glass 42 within the housing by trapping it between the retainer and the housing such that sight glass 42 is recessed within housing 38. The retainer has a cylindrical inner surface 44 and a cylindrical outer surface 46. The exposed axial end portion 48 extends axially beyond housing 38 and has a pair of diametrically opposite end edge driving recesses 50.

The retainer wrench is engaged with retainer 36 by locating guide member 12 within retainer 36 such that the exterior surface of the guide member slidably engages inner surface 44 of the retainer. Projections 32 and 34 are located within recesses 50, while stop surface 16 engages exposed end portion 48 of the retainer. The engagement of projections 32 and 34 with recesses 50 provides a positive driving engagement between the retainer and wrench. The engagement of stop surface 16 with retainer exposed end portion 48 prevents over-insertion of the wrench such that the guide member does not contact and damage the sight glass.

As illustrated in FIG. 5, a standard $\frac{3}{8}$ inch ratchet wrench drive assembly 52 can be simply coupled to base member 10 by locating its drive shaft 54 within bore 22. In this manner, handle 56 extends perpendicular relative to the guide member for increased leverage.

Although the invention has been described in considerable detail with particular reference to a certain preferred embodiment thereof, variations and modifications can be affected within the spirit and scope of the invention as defined in the appended claims.

What is claimed is:

1. A wrench for removing and installing hollow cylindrical retainers having end edge driving recesses, comprising:

a base cylindrical member having first and second opposite axial ends, a substantially planar stop surface on said first end and a bore in said second axial end for attaching a handle, said bore having a polygonal transverse cross-sectional configuration;

a cylindrical wall defining a tubular guide member having an axial end edge fixedly coupled to said base member and having a longitudinal axis substantially perpendicular to said stop surface, said guide member having diametrically opposite openings in said cylindrical wall; and an elongated bar lying on said stop surface and extending through said openings in said guide member, said bar being rectangular in transverse cross section.

2. An apparatus comprising:

a hollow cylindrical retainer threadedly coupled in a housing, said retainer having cylindrical inner and outer surfaces and an exposed axial end edge portion with diametrically opposite driving recesses; and a wrench for removing and installing said retainer including a base member having a substantially planar stop surface on a first axial end thereof for engaging said exposed axial end edge portion;

a guide member fixed to said base member, extending perpendicularly from said stop surface and engaging said cylindrical inner surface, and a pair of projections extending in opposite directions from said guide member parallel to and over said stop surface, said projections being received in said driving recesses of said end edge portion.

3. An apparatus according to claim 2 wherein said base member has coupling means for positively engaging a handle extending substantially perpendicular to said guide member.

4. An apparatus according to claim 3 wherein said coupling means extends from an opposite, second axial end of said base member.

5. An apparatus according to claim 4 wherein said coupling means comprises a bore in said second axial end having a polygonal transverse cross-sectional configuration.

6. An apparatus according to claim 2 wherein said guide member comprises an outer lateral surface which is cylindrical.

7. An apparatus according to claim 2 wherein said guide member comprises a hollow tube.

8. An apparatus according to claim 2 wherein said projections have rectangular transverse cross-sectional configurations.

9. An apparatus according to claim 2 wherein said projections comprise longitudinal ends of a single elongated bar extending across said stop surface and through recesses in said guide member.

10. An apparatus according to claim 9 wherein said guide member comprises a cylindrical tube.

* * * * *